US006450352B1

(12) United States Patent
DeJonge

(10) Patent No.: US 6,450,352 B1
(45) Date of Patent: Sep. 17, 2002

(54) CHILD-RESISTANT PUSH AND TWIST LOCKING CAP

(76) Inventor: Stuart W. DeJonge, 20 Schuler La., Easton, PA (US) 18042

( * ) Notice: Subject to any disclaimer, the term of this patent is extended or adjusted under 35 U.S.C. 154(b) by 0 days.

(21) Appl. No.: 09/552,909

(22) Filed: Apr. 20, 2000

Related U.S. Application Data

(63) Continuation-in-part of application No. 09/224,192, filed on Dec. 30, 1998.

(51) Int. Cl.[7] ..... B65D 41/04; B65D 41/06; B65D 55/02

(52) U.S. Cl. ..... 215/217; 215/208; 215/330; 215/332; 215/334

(58) Field of Search ..... 215/217, 208, 215/223, 220, 330, 332, 334, 335, 341, 204, 218, 258, 329; 220/255, 256, 290, 296, 300

(56) References Cited

U.S. PATENT DOCUMENTS

| | | | | |
|---|---|---|---|---|
| 2,041,403 A | | 5/1936 | Fergusson | |
| 3,072,276 A | | 1/1963 | Nichol | |
| 3,199,704 A | | 8/1965 | Davidson | |
| 3,339,770 A | | 9/1967 | Weigand | |
| 3,595,417 A | | 7/1971 | Musher | |
| 3,733,001 A | | 5/1973 | Gach | |
| 3,749,970 A | | 7/1973 | Affleck | |
| 3,880,314 A | | 4/1975 | Akers | |
| 3,927,783 A | | 12/1975 | Bogert | |
| 4,004,704 A | | 1/1977 | Hilaire | |
| 4,244,480 A | | 1/1981 | Planas | |
| 4,387,821 A | * | 6/1983 | Geiger | 215/332 |
| 4,444,327 A | | 4/1984 | Hedgewick | |
| 4,523,688 A | * | 6/1985 | Puresevic et al. | 215/220 |
| 4,567,992 A | | 2/1986 | Davis | |
| 4,579,238 A | | 4/1986 | Herr | |
| 4,801,028 A | * | 1/1989 | Puresevic et al. | 215/220 |
| 4,832,218 A | * | 5/1989 | Gibilisco | 215/220 |
| 4,875,603 A | | 10/1989 | Weinstein | |
| 4,998,632 A | * | 3/1991 | Morris, Sr. | 215/220 |
| 5,020,681 A | * | 6/1991 | Kusz | 215/220 |
| 5,114,029 A | | 5/1992 | Gibilisco | |
| 5,127,553 A | | 7/1992 | Weinstein | |
| 5,161,706 A | | 11/1992 | Weinstein | |
| 5,181,624 A | | 1/1993 | Petit | |
| 5,184,760 A | | 2/1993 | Weinstein | |
| 5,213,223 A | | 5/1993 | Minnette | |
| 5,615,787 A | * | 4/1997 | Morris, Sr. | 215/220 |
| 5,893,473 A | * | 4/1999 | Morris, Sr. | 215/220 |
| 6,085,920 A | * | 7/2000 | Moretti | 215/220 |

* cited by examiner

*Primary Examiner*—Stephen K. Cronin
*Assistant Examiner*—Niki M. Eloshway
(74) *Attorney, Agent, or Firm*—Kenneth P. Glynn, Esq.

(57) ABSTRACT

The present invention is a child-resistant push and twist locking container. It includes a squeeze tube container having a neck and a dispensing orifice at an outer end of the neck, and the neck has one of a locking track and a locking lug. There is also a cap having at least three components and being assembled to cooperate with each other. This cap includes an outer shell having a sidewall and a top, the outer shell being adapted to receive and contain an inner top, a spring mechanism and an inner collar member; an inner top inserted into the outer shell and including a sealing liner for sealing the container; and, an inner collar member fixedly inserted into the outer shell and having the other of the locking track and the locking lug. There is a spring mechanism on at least one of the outer shell, the inner top and between the outer shell as a separate piece so as to permit the cap to be pushed and twisted into a closed side of the locking track wherein the spring mechanism biases the cap away from the container to maintain the lug in the track closed side.

20 Claims, 3 Drawing Sheets

CHILD-RESISTANT PUSH AND TWIST LOCKING CAP

REFERENCE TO RELATED APPLICATION

This application is a Continuation-In-Part of currently pending U.S. patent application Ser. No. 09/224,192, filed on Dec. 30, 1998 and entitled "Push and Twist Locking Child-Resistant Cap and Container", by the inventor herein.

BACKGROUND OF THE INVENTION

1. Field of the Invention

The present invention relates to a child resistant safety cap which has a push and twist feature, thus requiring a complex motion for effective opening. This invention is particularly useful for dangerous materials, such as drugs, and particularly adaptable to squeeze tubes.

2. Information Disclosure Statement

The following patents are representative of child resistant caps and closures, including compound motion-based child resistant caps.

U.S. Pat. No. 3,072,276 to Anthony Nichols describes a self locking tamper proof vial which comprises the combination of a closure member a container with a cylindrical open neck portion and a spring member, said closure member having a top wall and a cylindrical skirt portion, the cylindrical skirt portion have a plurality of projections spaced around the interior surface thereof and positioned in spaced relationship to the top portion of the closure member, said spring member having a resilient disc portion with a post positioned on one side thereof, said spring member being positioned in the closure in the space between the projections and top portion of the closure member and disc member, said spring member being supported by the plurality of projections in the space between said projections and the interior surface of the top portion of said closure member said container having a number of grooves around the cylindrical open neck portion each with one closed upright end terminated below the rim of said neck and an opposite end open at the rim of said neck, said grooves being spaced around the neck at intervals similar to the spacing of the projections of said closure member so then when closure is properly positioned over the rim of the neck and pressed to the neck the projections enter the open end of said grooves and the post of said spring member is pushed upwardly against the top wall of said closure by the force of the rim of the neck portion against the disc portion of the spring member, said top wall being strong enough to withstand the force of the post without being permanently distorted or broken, whereby if the closure is pressed to the neck of the container and then rotated so the projections enter the closed upright end the force of the disc portion of the spring member on the rim of the neck will keep the projections in the closed upright ends of the slots so the open neck of the container is sealed to form a tamper proof vial.

U.S. Pat. No. 3,339,770 to Bruno Weigand describes in combination with a container provided with a mouth portion: a cap having a cylindrical side wall applicable to the mouth portion container, circumferentially-spaced side lugs carried by the cap on the inside thereof, climbing cams carried by the mouth of the container and peripherally disposed thereon for engagement by said lugs when the cap is turned in the closing direction to draw the cap down, recess means for engagement by the lugs to preclude the cap from turning in the opening direction, and tensionable means depending from said side wall for securing the lugs in the recess means, said tensionable means including an annular extension member in the vicinity of said mouth portion in the applied position of the container, said extension member having a resilient wall portion disposed to extend alongside of said mouth with a free edge curved outwardly therefrom for spreading under tension by contact with a relatively fixed surface when the cap is turned in its closing direction.

U.S. Pat. No. 3,595,417 to Arthur Albert Musher describes a closure and plug for a container is provided with elements interengaging with other elements on the mouth of the container, to secure it against opening by young children. In one modification, the closure is provided with a combination safety plug and measuring device; the measuring device is provided with a more versatile structure, and a means of accurately varying the measured quantity, the closure is also improved.

U.S. Pat. No. 3,733,001 to Peter Gach discloses a container and child proof closure therefor. The container has a neck surrounding an opening. At least two flanges project from the neck. Each flange has a spirally expanding first camming surface and a downwardly directed helilcal second camming surface which terminaates at an inwardly directed end surface. The closure comprises outer and inner members. The outer member includes lugs for engaging the second camming surface as the cap is rotated on the container neck to a locked position for holding the closure on the neck. The inner member includes resilient means which ride of the first camming surfaces and abut the flange end when the closure is to the locked position to prevent removal of the closure. Movement of the inner closure member against spring means within the outer closure member permits the closure to be rotated from the locked position for removal from the container. In one embodiment, means is provided for further tightening the closure on the container after it is in the locked position.

U.S. Pat. No. 3,749,270 to Lyle Claud Affleck describes an arrangement, for closing a container such as a bottle or like container, including a cap within the skirt of which is mounted one or more projections, for example, pins. Each pin fits into a groove formed in or on the neck or similar formation on the container. Each groove has at least one indent within which the inserted pin can be located to hold the cap in a position to seal the container. The cap is provided with means to bias it away from the container when the latter is sealed, and an enlarged indented section within a groove is used so that the biassing action in combination with the enlarged indented section provide a closure for the container which cannot be easily undone by young children. In another arrangement, the pins are located on the container and the grooves within the cap.

U.S. Pat. No. 3,880,314 to Edward G. Akers describes a container has a neck defined by a cylindrical wall having a planar lip and a frusto-conical interior surface, with the neck opening reducing in diameter toward the interior of the container. The safety cap is cup-shaped having a planar top wall and cylindrical side wall, and having an inner dependent cylindrical skirt concentric with the side wall, the skirt being resilient and disposed to engage the container conical wall in assembled relation. Coacting ratchet lugs extend from the external surface of the container wall and the internal surface of the cap side wall, and are normally urged into engagement to prevent relative rotation of the container and cap by the spring action of the cap skirt and container conical wall. The ratchet lugs have coacting inclined cam surfaces which, in response to rotation of the cap in one direction, force axial inward movement of the cpa to move its top wall contiguous to the container lip; and the container wall and cap have interfering latch means which inhibit reverse rotation from this contiguous position.

U.S. Pat. No. 3,927,783 to Clayton Bogert describes an invention for a leak-proof protective safety closure for containers which is used to prevent inadvertent opening of the container by children or the like. The invention provides a cap having a top and sidewalls which has a wedge-shaped protrusion on the interior of the cap near the base of the sidewalls. A recessed relatively elongated and sloping track is provided on the neck of the container and the wedge rides in the track. Near the base of the track is a notch or groove which accommodates the wedge to lock the cap into position against inadvertent openings. There are pressure means in the form of a rigid ring below the underside of the top of the cap and a flexible plate which flexes while the wedge on the cap rides in the groove and remains under pressure when the wedge snaps into the notch to provide a leak-proof fit. To open the cap it is depressed against the action of the flexible plate to a point where the wedge comes out of the notch or groove and the cap is turned until it is free of the track.

U.S. Pat. No. 4,004,704 to Fernand Hilaire discloses a tamper-proof plastic closure device with safety means comprising and internally screw-threaded plug matching the screw-threaded and beaded neck of a container. The plug is retained by the neck bead engaging a groove formed in the outer skirt of the plug and the plug itself is covered by a cap in smooth frictional contact therewith. The central area of the internal surface of the flexible and bulged top wall the cap which is bounded by a rigid projecting circular rib, comprising means adapted to co-act with matching means provided int eh central area of the plug when a sufficient pressure is exerted on the area, so as to rotatably drive the plug and release same from the retaining bead.

U.S. Pat. No. 4,244,480 to Antonio Puig Planas describes and illustrates a cap for sealing containers comprising a hood member, a resilient sealing member adapted for press fit insertion in the container neck, an axial rod engaging internally with the sealing member and an annular portion fixedly attached to the hood member and adapted for retaining the sealing member.

U.S. Pat. No. 4,444,327 to Peter Hedgewick describes a safety container and closure assembly including an integrally-molded, one piece plastic cap having a sealing portion which provides an "oil-can" effect during axial and rotative motion of the cap/relative to the container. The sealing portion comprises a relatively thin, radially outwardly curved wall which is integrally joined to a relatively stiff annular base portion from which a peripheral skirt portion axially projects for receiving the mouth of the container. Integrally formed with the sealing portion is a relatively thin, annular biasing portion which, in turn, is integrally formed with a relatively stiff, inner, disc-like base portion. The biasing portion biases the sealing portion to axially spaced portions such that when the cap is placed on the container, the biasing portion biases the cap in a fixed axial sealing position relative to the container and simultaneously applies pressure to the sealing portion. Preferably, a rib comprising an 0-ring seal projects inwardly on the inner surface of the mouth portion of a container and simultaneously engages the sealing portion during the axial and rotative motion of the cap relative to the container.

U.S. Pat. No. 4,567,992 to Eugene E. Davis describes an invention providing a tubular container body and closure assembly with a smooth or flush outside surface. The assembly is provided with bayonet type child resistant closure and tear away tamper resistant band. The container body has a recess to receive a teartap on the tear away band so that the flush outside surface is maintained, the recess in the body being so positioned that when the tear tab is aligned with the recess an internal bead on the closure forming part of the bayonet type locking arrangement is aligned with an external locking slot on the body so that the closure can be applied to the body by a longitudinal downward movement.

U.S. Pat. No. 4,579,238 to James E. Herr describes a child-resistant, moisture-tight safety closure having an end wall with an annular depending skirt, the skirt having a plurality of locking lugs disposed on the inside thereof. The locking lugs cooperate with retaining notches adjacent to the open mouth of an associated container to releasably retain the closure on the container. A sealing plug integral with the end wall of the closure and concentric with the annular skirt effects a moisture-tight seal with the inner wall of the container. A plurality of resilient members are integral with the interior of the closure at the junction of the top wall and the skirt, the resilient members extending downwardly and inwardly so as to engage the end surface of the container opening. The compression of the resilient members serves to bias the locking lugs on the closure into locking relationship with the retaining notches on the container with a force sufficient to ensure the child-resistant characteristics of the closure.

U.S. Pat. No. 4,875,603 to Jack Weinstein describes the present invention is directed to a metered dispensing cap system for containers such as tubes and the like. The system has a base element which is attachable to the neck of a squeezable container and which has a sidewall portion and a top. The base element has an opening in the top for outflow of a material from a squeezable container into a meter element. This base element may be removably attachable, e.g. by being screwed on, or may be permanently attached, e.g. by being integrally molded with the container. A one way valve is located in the opening of the base element to permit the flow of material from a container through the opening while preventing backflow. The system also includes a meter element which acts like an inverted trap and which has a sidewall portion and a top with an opening in the top for dispensing of the material therefrom. The sidewall portion of the meter element is slightly larger than and has the same across section shape as the sidewall portion of the base element and this sidewall portion of the meter element is higher than and located about and encompasses the sidewall portion of the base element. Further, the meter element is vertically slidable along the sidewall portion of the base element with an upward position for receiving a volume of material in a pre-determined amount when the squeezable container is squeezed and downward position whereby the opening in the top of the meter element allows for dispensing of the desired amount of fluid when the meter is pushed down.

U.S. Pat. No. 5,114,029 to Kenneth J. Gibilisco discloses a child resistant bottle closure assemblage comprising an outer cap member, an inner cap member and an interlocking member disposed between the inner and outer cap members. When secured to a bottle in its normal, upright position, the outer cap member can be rotated without engaging the interlocking member so that the assemblage can not be removed from the bottle. When the bottle is inverted so that the interlocking member engages the outer cap member, rotation of the outer cap member results in removal of the entire assemblage from the bottle.

U.S. Pat. No. 5,127,553 to Jack Weinstein describes the present invention is a liquid metered dispensing container of the squeezable type. The squeezable container has an opening for dispensing liquid therefrom at one end and a bottom at the other end. A non-flexible trap chamber is connected to the opening and extends outwardly therefrom. The trap chamber has a lower end inserted into the container opening and has an inlet orifice extending from the lower end into the container. The inlet orifice is adapted to receive a dip tube which is attached thereto and extends close to or at the bottom of the container. The trap chamber has an upper end with a dispensing orifice. This is small enough to prevent dripping of liquid therefrom by gravity when the bottle is inverted but is large enough to dispense liquid therefrom when the bottle itself is squeezed. A one way valve is connected to the lower end of the trap chamber which permits liquid to flow from the container to the trap chamber but not vice versa. The trap chamber may have indicia so that exact dosage levels of different amounts may be squeezed into the chamber, or the chamber itself may have a single, predetermined volume.

U.S. Pat. No. 5,161,706 to Jack Weinstein describes a twist and push snap-on, child resistant cap and container has an inner cap seal which is easily snapped onto a neck of a container and an outer cap. The outer cap has a top and sidewalls and has a greater cross-sectional area than the inner cap, and receives and physically restrains the inner cap within the outer cap such that the inner cap may be moved upwardly and downwardly within it over specified distance. The outer cap includes a locking lug located on its inside wall adapted to snap over a circumferential bead located on the neck of the container. There is a stop located on the inside wall of the outer cap and is freely rotatable about the neck of the container except when in contact with stop(s) on the neck of the container at its level of rotation when the outer cap is on the container. A spring mechanism located between the inner and outer cap so as to bias downwardly the inner cap. There is a bead located circumferentially about its neck with a break to allow the lug and stop of the outer cap to pass therethrough. A first stop is located on the neck near but not above or below the opening in the bead and a second stop, larger than the first, is capable of preventing movement of the outer cap when rotated with its stop against its second stop.

U.S. Pat. No. 5,181,624 to Robert Petit discloses a flask which is closed by a closing device comprising a closing cap cooperating with the neck of the flask. The device includes two open ramps diametrically opposite provided on the neck of the flask and in the center of which is formed an axially extending projection, the closing cap including a cylindrical skirt formed inside with two diametrically opposite latching studs and each carrying a housing which cooperates with one of the projections.

U.S. Pat. No. 5,184,760 to Jack Weinstein describes the present invention is directed to a metered side dispensing cap system for containers such as tubes and the like. It includes a chamber unit having an inlet opening in the bottom for flow of a material from a squeezable container into the chamber. The chamber unit has an outlet opening on a sidewall located near the bottom for dispensing material from the chamber in a metered amount. A one-way valve located in the inlet opening on the bottom of the chamber unit permits flow of material through that opening and prevents backflow of material. A piston mechanism moves upwardly and downwardly within the chamber. The piston mechanism is capable of upward movement by material entering the chamber unit when a squeezable container is squeezed and material enters the chamber unit through its inlet opening. The piston is capable of downward movement when its wide top is pushed downward, so as to dispense material through the sidewall outlet opening of the chamber unit. The system is attachable to an open neck of a squeezable container.

U.S. Pat. No. 5,213,223 to Jeffrey C. Minnette discloses and adaptor and a closure which are formed with cooperating child resistant elements so that the adaptor can be applied to any type of container and the closure can be removed from the adaptor only by manipulation of the child resistant stops. Both the adaptor and closure are molded with precision surfaces as by injection molding so that the closure can be sealingly attached to the adaptor without the use of excessive force.

Notwithstanding the prior art, the present invention is neither taught nor rendered obvious thereby.

SUMMARY OF THE INVENTION

The present invention is a push and twist locking child-resistant cap and container. It includes a squeeze tube container having a neck and a dispensing orifice at an outer end of the neck, and the neck has one of a locking track and a locking lug. There is also a cap having at least three components and being assembled to move together as a single unit. This cap includes an outer shell having a sidewall and a top, the outer shell being adapted to receive and contain an inner top and an inner collar member; an inner top inserted into the outer shell and having a sealing liner for sealing the dispensing orifice of the container; and, an inner collar member fixedly inserted into the outer shell below the inner top and having the other of the locking track and said locking lug. The locking track is generally "U"-shaped with one side of the "U"-shape being an open side for entry and removal of the locking lug, the base of the "U"-shape being at right angles to a central axis of the neck and the other side of the "U"-shape being a truncated, closed side with a locking position for the locking lug. A spring mechanism, which is located on at least one of the inner top, the outer shell or as a separate piece between the outer shell and the inner top, permits the cap to be pushed and twisted into the closed side of the "U"-shaped track so that the spring mechanism biases the cap away from the container to maintain the locking lug in the closed side of the "U"-shaped track. In another embodiment, in place of the container neck is a hollow tube with the same adaptations for attachment to a container.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

The present invention is adapted for containers requiring child resistant features, and especially, but not limited to squeeze containers and squeeze tubes. For example, some medications may create a safety hazard to children and come in cream or gel form in squeeze tubes and the present invention child resistant safety cap system would be ideal.

Figure 2:
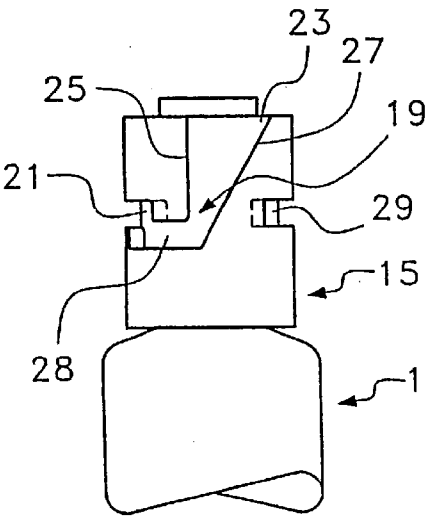
Figure 1:
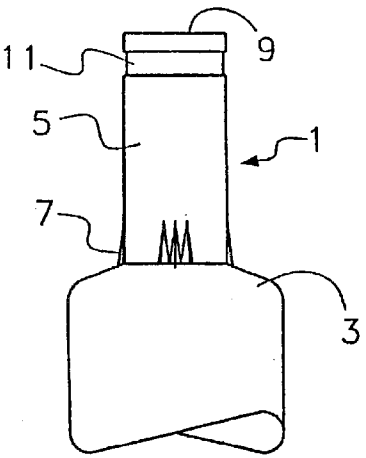
FIG. 1 shows a side view of a container.

Referring to FIGS. 1 through 5, identical parts are identically numbered and may not be affirmatively discussed with every Figure and so the Figures should be viewed collectively. Thus, FIG. 1 shows a side view of a container 1 which has a main body 3, a neck 5, and a dispensing orifice 9. There is also an annular groove 11 and pinch wedges 7 to allow for permanent, anti-rotation attachment of outer shell 15 in FIGS. 2 and 3. In one embodiment of the present invention, the outer shell 15 is a retrofit and in another embodiment of the present invention it may be molded in place with the container. When it is molded in place with the container, it is referred to as the container neck and when it is a separate retrofit piece, it is referred to as a hollow tube. In FIG. 2, hollow tube 15 includes a locking track 19 which is generally "U-shaped". It includes a first leg 23 of the U, a bottom U portion 28 and a second leg 21. This track receives a locking lug which will be described below in conjunction with FIGS. 4 and 5. As an alternative, in place of locking track 19 and locking track 29 located on outer shell 15, locking lugs could be located thereon and the locking track could be located on the inside of a corresponding cap. In other words, the hollow tube 15 could have either the tracks or the lugs and the cap would have the other of the tracks or lugs.

Figure 4:
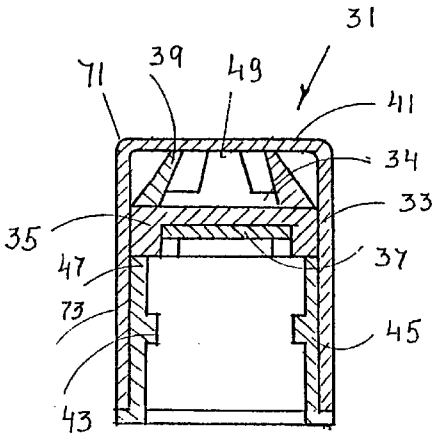
FIG. 4 shows a side cut view of a cap component of the present invention and FIG. 5 shows a side view of that component in an uncompressed form attached to the container and collar shown in FIGS. 2 and 3 above.
Figure 3:
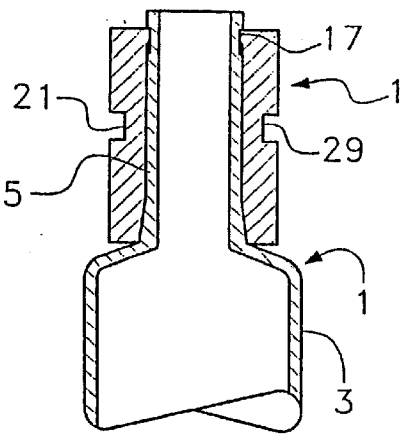
FIG. 2 shows a side view of a container with a hollow tube component for a present invention child resistant safety cap and FIG. 3 shows a side cut view thereof.
Figures 5, 6, 7, 8:
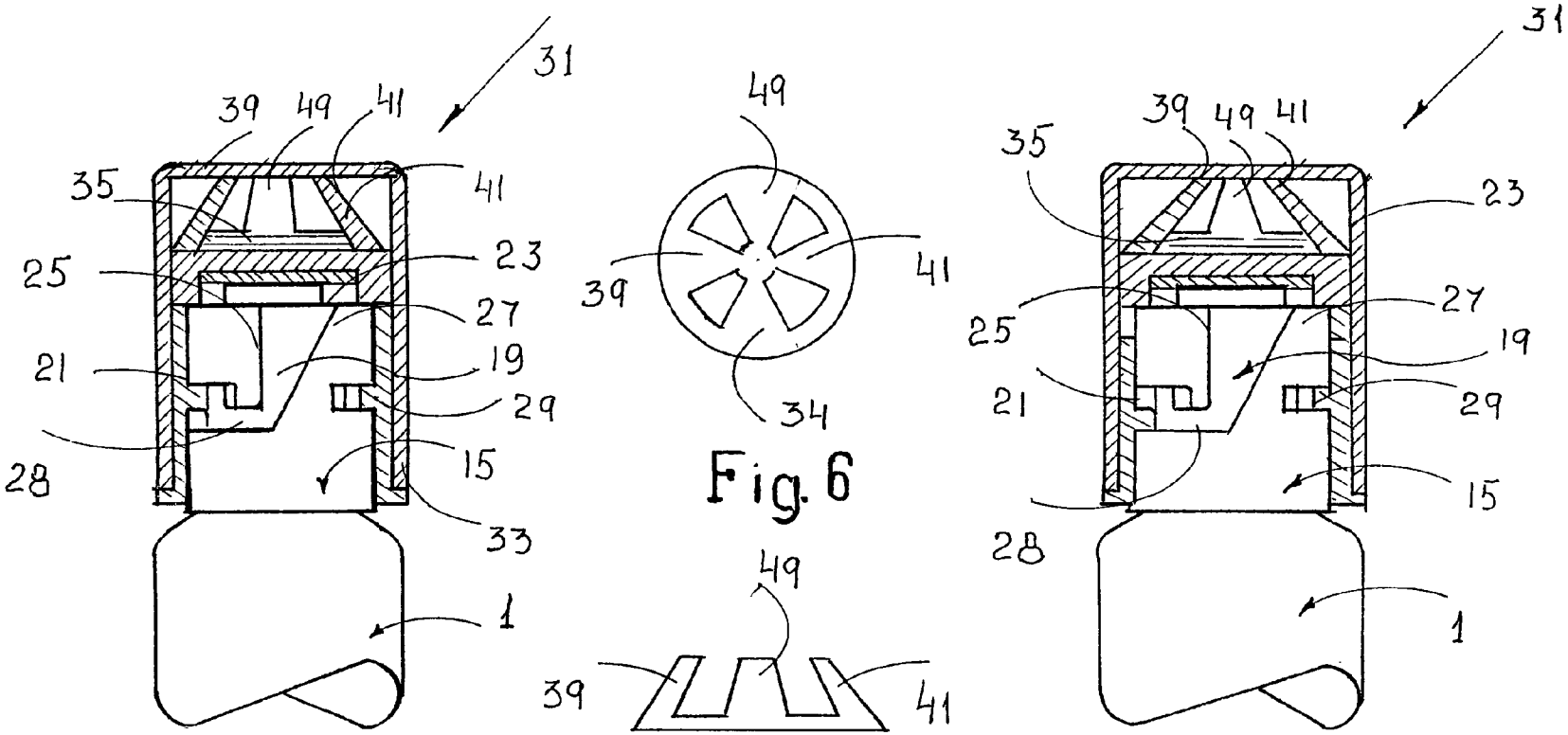
FIGS. 6 and 7 show a top and a side view, respectively, of a spring mechanism of the present invention child resistant safety cap.
FIG. 8 shows a side view of the cap component shown in FIG. 5, but in compressed form.

FIG. 4 shows a side cut view of a cap 31 which includes an outer shell 33, a spring mechanism 34, an inner top 35 and an inner collar 47. Outer shell 33 is sized and shaped for receiving spring mechanism 34, inner top 35 and inner collar 47 so that they cannot be easily separated from one another once they have been assembled. This attachment may be achieved by force fit, gluing, sonic welding or other attachment means available in the art or combinations thereof. Outer shell 33 includes a top 71, and sidewall 73. Additionally, inner top 35 has a sealing liner 37 for sealing the dispensing orifice 9 of the container 1. The sealing liner 37 may be glued onto a bottom surface of the inner top 35 or snap-fitted into it. Spring mechanism 34 includes spring extensions 36, 39, 41, and 49 which maintain cap 31 relative to hollow tube 15 in their compressed position, i.e. with inner top 35 biased upwardly from the top of hollow tube 15 with sealing liner 37 still in a sealing position. Other alternatives for spring arrangements are available, which will be discussed hereinafter. Note that inner collar 47 includes locking lugs 43 and 45. These will ride down first leg 23 of locking track 19, pass through bottom U portion 28 and rest in a locked position in second leg 21. Due to the spring force such as is illustrated in FIG. 5 when cap 31 is in a locked position, inner collar 47 will not drop out of second leg 21 and cannot be opened by mere turning. A user must press down on cap 31 and then rotate while pressing down to get out of second leg 21, pass through bottom U portion 28 and up first leg 23 to remove cap 31 therefrom. Corresponding lug 45 operates in a similar fashion with respect to locking track 29. Note in FIG. 2 that first leg 23 has a vertical side 25 and a sloped side 27. Note also that in FIG. 5, the spring mechanism is in uncompressed form.

FIGS. 6 and 7 show top and side views, respectively, of spring mechanism 34. Spring mechanism, which includes extensions 34, 39, 41 and 49, is a separate individual piece which is located between inner top 35 and outer shell 33. Alternative spring embodiments are discussed hereinafter.

FIG. 8 shows a side view of the safety cap shown in FIG. 5 but the spring mechanism being in compressed form. When a user presses down on cap 31, outer shell 33 and spring extensions 34, 39, 41 and 49 will compress and outer shell 31 will move closer to inner top 35 causing inner collar 47 to be moved downward since outer shell 33 overlaps inner collar 47 at a bottom portion of the cap 31. When this occurs, lugs 43 and 45 will move into a bottom portion of the locking track 19 and will thus be free to move up the area surrounding the first leg 23 when the cap 31 is twisted. In this way the cap 31 can be removed from the container 1.

Figure 10:
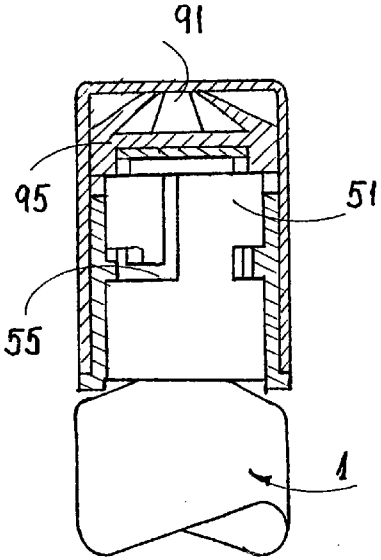
FIGS. 9 and 10 show a side cut view of an alternative embodiment of the present invention child resistant safety cap in uncompressed form and in compressed form, respectively; and, FIGS. 11 and 12 show a side cut view of still another alternative embodiment of the present invention child resistant safety cap in uncompressed form and in compressed form, respectively.
Figure 9:
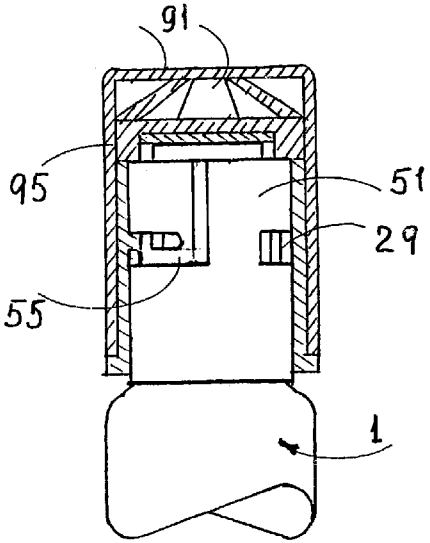

FIGS. 9 and 10 show the containers and the caps in uncompressed form and compressed form, which are identical to FIGS. 5 and 8, respectively, but having alternative hollow tube 51 and alternative spring mechanism 91. U-shaped track 55 has parallel vertical sides on its open leg. Spring mechanism 91 is integrally attached to a top portion of inner top 95.

Figure 12:
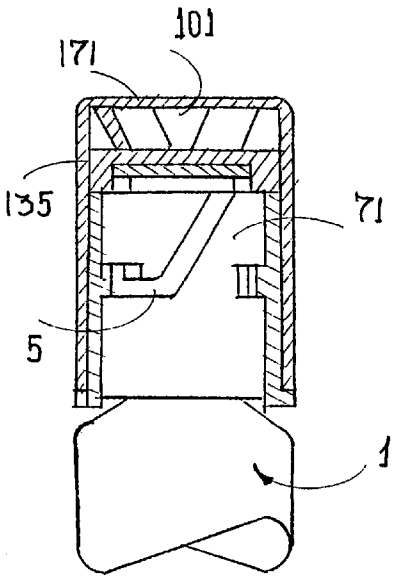
Figure 11:
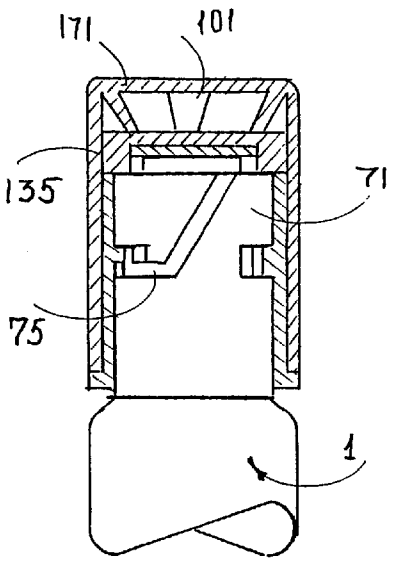

FIGS. 11 and 12 show the containers and the caps in uncompressed form and compressed form, which are identical to FIGS. 5 and 8, respectively, but having alternative hollow tube 71 and alternative spring mechanism 101. U-shaped track 75 has parallel vertical sides on its open leg. Spring mechanism 101 is integrally attached to an underside of top portion 171 of outer shell 135.

Obviously, numerous modifications and variations of the present invention are possible in light of the above teachings. It is therefore understood that within the scope of the appended claims, the invention may be practiced otherwise than as specifically described herein.

What is claimed is:

1. A child-resistant push and twist locking cap and container, which comprises:

(a) a container having a neck and a dispensing orifice at an outer end of said neck, said neck having one of a locking track and a locking lug; and, (b) a cap having at least three components and being assembled to cooperate with each other, said cap including:

(i) an outer shell having a sidewall and a top, said outer shell being adapted to receive and contain an inner top and an inner collar member;

(ii) an inner top member inserted into said outer shell, having a top, and having a sealing protrusion located at its center and extending downwardly therefrom for sealing said dispensing orifice of said container, and having a sidewall extending downwardly therefrom to abut an inner collar, wherein said inner top is in contact with said outer shell and said sidewall abuts an inner collar;

(iii) an inner collar member fixedly inserted into said outer shell below said inner top member and abutting said inner top member sidewall, and having the other of said locking track and said locking lug; and, (iv) a spring mechanism located between said inner top and said outer shell so as to permit said cap to be pushed and twisted into said closed side of said "U"-shaped track wherein said spring mechanism biases said cap away from said container to maintain said locking lug in said closed side of said "U"-shaped track;

wherein said locking track is generally "U"-shaped with one side of the "U"-shape being an open side for entry and removal of said locking lug, the other side of said "U"-shape being a truncated, closed side with a locking position for said locking lug and the base of said "U"-shape joining said open side and said truncated closed side.

2. The child-resistant push and twist locking cap and container of claim 1 wherein said spring mechanism is integrally formed on an upper portion of said inner top and extends upwardly therefrom.

3. The child-resistant push and twist locking cap and container of claim 2 which includes a sealing liner located on a bottom surface of said inner top.

4. The child-resistant push and twist locking cap and container of claim 3 wherein said spring mechanism includes at least one spring extension.

5. The child-resistant push and twist locking cap and container of claim 4 wherein said locking track is located on an outside wall of said container neck and said locking lug is located on an inside wall of said inner collar member.

6. The child-resistant push and twist locking cap and container of claim 1 wherein said spring mechanism is integrally formed on said outer shell and projects downwardly from a top portion of said outer shell.

7. The child-resistant push and twist locking cap and container of claim 1 wherein said spring mechanism is a separate piece.

8. The child-resistant push and twist locking cap and container of claim 1 wherein said spring mechanism is a separate piece.

9. The child-resistant push and twist locking cap and container of claim 8 which includes a sealing liner located on a bottom surface of said inner top.

10. The child-resistant push and twist locking cap and container of claim 8 wherein said spring mechanism includes at least one spring extension.

11. The child-resistant push and twist locking cap and container of claim 10 wherein said locking track is located on an outside wall of said container neck and said locking lug is located on an inside wall of said inner collar member.

12. A child-resistant push and twist locking cap and container, which comprises:

(a) a squeeze tube having a neck and a dispensing orifice at an outer end of said neck, said neck having one of a locking track and a locking lug; and, (b) a cap having at least three components and being assembled to cooperate with each other, said cap including:

(i) an outer shell having a sidewall and a top, said outer shell being adapted to receive and contain an inner top and an inner collar member;

(ii) an inner top member inserted into said outer shell, having a top, and having a sealing protrusion located at its center and extending downwardly therefrom for sealing said dispensing orifice of said container, and having a sidewall extending downwardly therefrom to abut an inner collar, wherein said inner top is in contact with said top of said outer shell and said sidewall abuts an inner collar;

(iii) an inner collar member fixedly inserted into said outer shell below said inner top and abutting said inner top member sidewall, and having the other of said locking track and said locking lug; and, (iv) a spring mechanism located between said inner top and said outer shell so as to permit said cap to be pushed and twisted into said closed side "U"-shape track wherein said spring mechanism biases said cap away from said container to maintain said locking lug in said closed side of said "U"-shaped track;

wherein said locking track is generally "U"-shaped with one side of the "U"-shape being an open side for entry and removal of said locking lug, the other side of said "U"-shape being a truncated, closed side with a locking position for said locking lug and the base of said "U"-shape joining said open side and said truncated closed side.

13. The child-resistant push and twist locking cap and container of claim 12 wherein said spring mechanism is integrally formed on an upper portion of said inner top and extends upwardly therefrom.

14. The child-resistant push and twist locking cap and container of claim 12 wherein said spring mechanism is integrally formed on said outer shell and projects downwardly from a top portion of said outer shell.

15. A child-resistant push and twist locking cap, which comprises:

(a) a hollow tube having a dispensing orifice at an outer end thereof, said hollow tube being adapted for attachment to a neck of a container, said hollow tube having one of a locking track and a locking lug; and, (b) a cap having at least three components and being assembled to cooperate with each other, said cap including:

(i) an outer shell having a sidewall and a top, said outer shell being adapted to receive and contain an inner top and an inner collar member;

(ii) an inner top member inserted into said outer shell, having a top, and having a sealing protrusion located at its center and extending downwardly therefrom for sealing said dispensing orifice of said container, and having a sidewall extending downwardly therefrom to abut an inner collar, wherein said inner top is in contact with said top of said outer shell and said sidewall abuts an inner collar; and, (iii) an inner collar member fixedly inserted into said outer shell below said inner top member and abutting said inner top member sidewall, having the other of said locking track and said locking lug;

(iv) a spring mechanism located between said inner top and said outer shell so as to permit said cap to be pushed and twisted into said closed side "U"-shape track wherein said spring mechanism biases said cap away from said container to maintain said locking lug in said closed side of said "U"-shaped track;

wherein said locking track is generally "U"-shaped with one side of the "U"-shape being an open side for entry and removal of said locking lug, the other side of said "U"-shape being a truncated, closed side with a locking position for said locking lug and the base of said "U"-shape joining said open side and said truncated closed side.

16. The child-resistant push and twist locking cap and container of claim 15 wherein said spring mechanism is integrally formed on an upper portion of said inner top and extends upwardly therefrom.

17. The child-resistant push and twist locking cap and container of claim 16 which includes a sealing liner located on a bottom surface of said inner top.

18. The child-resistant push and twist locking cap and container of claim 15 wherein said spring mechanism is integrally formed on said outer shell and projects downwardly from a top portion of said outer shell.

19. The child-resistant push and twist locking cap and container of claim 15 wherein said spring mechanism is a separate piece.

20. The child-resistant push and twist locking cap of claim 15 wherein said spring mechanism includes at least one spring extension.

* * * * *